US011242226B2

(12) United States Patent
Sun et al.

(10) Patent No.: US 11,242,226 B2
(45) Date of Patent: Feb. 8, 2022

(54) ELEVATOR DOOR SAFETY CONTROL

(71) Applicant: OTIS ELEVATOR COMPANY, Farmington, CT (US)

(72) Inventors: Fanping Sun, Glastonbury, CT (US); Joseph V. Mantese, Ellington, CT (US); Walter Thomas Schmidt, Marlborough, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 746 days.

(21) Appl. No.: 15/978,249

(22) Filed: May 14, 2018

(65) Prior Publication Data

US 2019/0345006 A1 Nov. 14, 2019

(51) Int. Cl.
*B66B 13/24* (2006.01)
*B66B 13/14* (2006.01)

(52) U.S. Cl.
CPC ..... *B66B 13/24* (2013.01); *B66B 13/146* (2013.01)

(58) Field of Classification Search
CPC ..... G05B 19/048; G05B 2219/2659; B66B 1/3415; B66B 3/00; B66B 3/002; B66B 5/0031; B66B 13/26; B66B 13/22; B66B 1/3492; B66B 5/027; B66B 5/0018; B66B 5/0012; B66B 5/0006; B66B 1/463; B66B 13/146; B66B 13/24; B66B 5/00; B66B 5/0037; B66B 13/00; B66B 13/02; B66B 5/005; B66B 5/02; B66B 5/021; B66B 5/0056; E21F 17/107
See application file for complete search history.

(56) References Cited

U.S. PATENT DOCUMENTS

| | | | | |
|---|---|---|---|---|
| 4,753,323 | A | 6/1988 | Kahkipuro | |
| 6,968,746 | B2 | 11/2005 | Shank et al. | |
| 7,044,271 | B2 | 5/2006 | De Coi | |
| 8,284,071 | B2 | 10/2012 | Peng et al. | |
| 9,212,028 | B2 | 12/2015 | Novak | |
| 9,751,727 | B1 * | 9/2017 | Novak | B66B 13/26 |
| 2003/0085679 | A1 * | 5/2003 | Bledin | E05F 15/46 318/264 |
| 2007/0068741 | A1 | 3/2007 | Janos et al. | |

(Continued)

FOREIGN PATENT DOCUMENTS

| | | | |
|---|---|---|---|
| CN | 203006680 | U | 6/2013 |
| CN | 204508529 | U | 7/2015 |

(Continued)

OTHER PUBLICATIONS

Office Action dated Mar. 31, 2021 for Chinese Application No. 201910388893.4.

*Primary Examiner* — Marlon T Fletcher
(74) *Attorney, Agent, or Firm* — Cantor Colburn LLP

(57) ABSTRACT

Embodiments include techniques for operating an elevator safety control system and method. The techniques include charging one or more portions of an elevator system, the elevator system includes an elevator door and elevator frame, and monitoring a charge on the one or more portions of the elevator system. In addition, the techniques include detecting a change in the charge on the one or more portions of the elevator system, and responsive to the detection, controlling an operation of the elevator door.

16 Claims, 4 Drawing Sheets

300

400

(56) References Cited

U.S. PATENT DOCUMENTS

| | | | | |
|---|---|---|---|---|
| 2010/0141267 | A1* | 6/2010 | Quinn | B66B 5/0031 324/549 |
| 2010/0244860 | A1 | 9/2010 | Wisspeintner et al. | |
| 2016/0016758 | A1* | 1/2016 | Lee | B66B 13/26 187/317 |
| 2018/0162691 | A1* | 6/2018 | Herkel | B66B 13/22 |
| 2018/0339878 | A1* | 11/2018 | Fever | B66B 1/52 |
| 2019/0010021 | A1* | 1/2019 | Sarkar | B66B 5/0037 |
| 2019/0144242 | A1* | 5/2019 | Shijo | B66B 7/00 187/393 |
| 2019/0330026 | A1* | 10/2019 | Schmidt | B66B 13/26 |
| 2019/0345006 | A1* | 11/2019 | Sun | B66B 13/24 |
| 2020/0331724 | A1* | 10/2020 | Stuppi | B66B 1/463 |

FOREIGN PATENT DOCUMENTS

| | | | |
|---|---|---|---|
| CN | 204675589 | U | 9/2015 |
| CN | 105164038 | A | 12/2015 |
| CN | 106285280 | A | 1/2017 |
| CN | 106672763 | A | 5/2017 |
| CN | 107434204 | A | 12/2017 |
| DE | 112013004963 | T5 | 7/2015 |
| JP | 07149489 | A | 6/1995 |
| JP | 2001089054 | A | 4/2001 |
| JP | 2011051753 | A | 3/2011 |
| JP | 201613876 | A | 1/2016 |
| WO | 03069104 | A1 | 8/2003 |
| WO | 2004001438 | A2 | 12/2003 |

* cited by examiner

ELEVATOR DOOR SAFETY CONTROL

BACKGROUND

The present disclosure relates generally to elevator systems, and more specifically to elevator door safety control.

In today's environment, elevator systems are used to conveniently and efficiently transport people and goods in buildings having multiple floors. Elevators can be designed to transport various numbers of people and/or support different weights of cargo. Depending on the intended use of the elevator, such as moving cargo in a service elevator or carrying travelling passengers to various office or residential spaces, the presentation of the inside of the elevators can vary from padded walls to elegant mirrors and designs for the passengers enjoyment. In addition, various displays and audio can be provided to occupy the passengers until their destination is met. Regardless of the elevator design, the safety and protection of the cargo and passengers must be provided for.

BRIEF DESCRIPTION

According to one embodiment, a method for operating a sensing device of an elevator door safety control system is provided. The method includes charging one or more portions of an elevator system, the elevator system includes an elevator door and elevator frame, and monitoring a charge on the one or more portions of the elevator system. The method also includes detecting a change in the charge on the one or more portions of the elevator system, and responsive to the detection, controlling an operation of the elevator door.

In addition to one or more of the features described above, or as an alternative, further embodiments may include detecting the change in charge on the elevator door.

In addition to one or more of the features described above, or as an alternative, further embodiments may include detecting the change in charge on the elevator frame.

In addition to one or more of the features described above, or as an alternative, further embodiments may include reversing the operation of the elevator door responsive to the detection.

In addition to one or more of the features described above, or as an alternative, further embodiments may include stopping an operation of the elevator door responsive to the detection.

In addition to one or more of the features described above, or as an alternative, further embodiments may include resuming the operation of the elevator door after a configurable delay and detecting normal operating current in the elevator.

In addition to one or more of the features described above, or as an alternative, further embodiments may include reducing a speed of the elevator door responsive to the detection.

In addition to one or more of the features described above, or as an alternative, further embodiments may include reducing a speed of the elevator door in the reverse direction responsive to the detection.

In addition to one or more of the features described above, or as an alternative, further embodiments may include the elevator door or the elevator frame being composed of a metal capable of being charged by the energy source.

In addition to one or more of the features described above, or as an alternative, further embodiments may include operating the elevator door according to a first operation upon the detection in a first location based on operating in a first direction and operating the elevator door according to a second operation upon the detection in a second location, wherein the first operation is different than the second operation and the first location is different than the second location.

According to one embodiment, an elevator control safety system, the system having one or more elevator cars of an elevator system, the one or more elevator cars each include an elevator door and frame, and an energy source coupled to the one or more elevator cars. The elevator control safety system includes a current sensor electrically coupled to the energy source and the one or more elevator cars to perform a detection, and an elevator controller operably coupled to the current sensor and the elevator system, the elevator controller configured to control the elevator door responsive to a signal received from the current sensor.

In addition to one or more of the features described above, or as an alternative, further embodiments may include detecting the change in charge on the elevator door.

In addition to one or more of the features described above, or as an alternative, further embodiments may include detecting the change in charge on the elevator frame.

In addition to one or more of the features described above, or as an alternative, further embodiments may include reversing the operation of the elevator door responsive to the detection.

In addition to one or more of the features described above, or as an alternative, further embodiments may include stopping the operation of the elevator door responsive to the detection.

In addition to one or more of the features described above, or as an alternative, further embodiments may include resuming the operation of the elevator door after a configurable delay and detecting normal operating current in the elevator.

In addition to one or more of the features described above, or as an alternative, further embodiments may include reducing a speed of the elevator door responsive to the detection.

In addition to one or more of the features described above, or as an alternative, further embodiments may include reducing a speed of the elevator door in the reverse direction responsive to the detection.

In addition to one or more of the features described above, or as an alternative, further embodiments may include the elevator door or the elevator frame being composed of a metal capable of being charged by the energy source.

In addition to one or more of the features described above, or as an alternative, further embodiments may include operating the elevator door according to a first operation upon the detection in a first location based on operating in a first direction and operating the elevator door according to a second operation upon the detection in a second location, wherein the first operation is different than the second operation and the first location is different than the second location.

BRIEF DESCRIPTION OF THE DRAWINGS

The following descriptions should not be considered limiting in any way. With reference to the accompanying drawings, like elements are numbered alike.

DETAILED DESCRIPTION

The design of elevator systems and in particular elevator doors, the design must include a clearance between the elevator door and the wall not only to provide space for the operation of the elevator doors but also because of construction and design codes. The limbs and fingers of passengers that are travelling on the elevator are exposed to the moving elevator doors during operation and are vulnerable to the pinch points between the elevator door and wall.

The techniques provided herein provide an improvement over previous solutions. For example, in configurations using energy radiation based sensors such as light curtains, often time blind spots occur resulting in portions of the elevator that are not protected when these types of sensors are used alone. In one or more embodiments, an existing metal landing door is adapted to become part of the touch-sensing circuitry of the enhanced elevator safety system and can be implemented in combination with light curtains and other safety devices. No additional metal panels are required to convert the elevator doors to the touch-sensing circuit to provide the increased safety for the travelling passengers. The techniques described herein implementing an electrostatic touch sensor provided in an enhanced door safety system.

Figure 1:
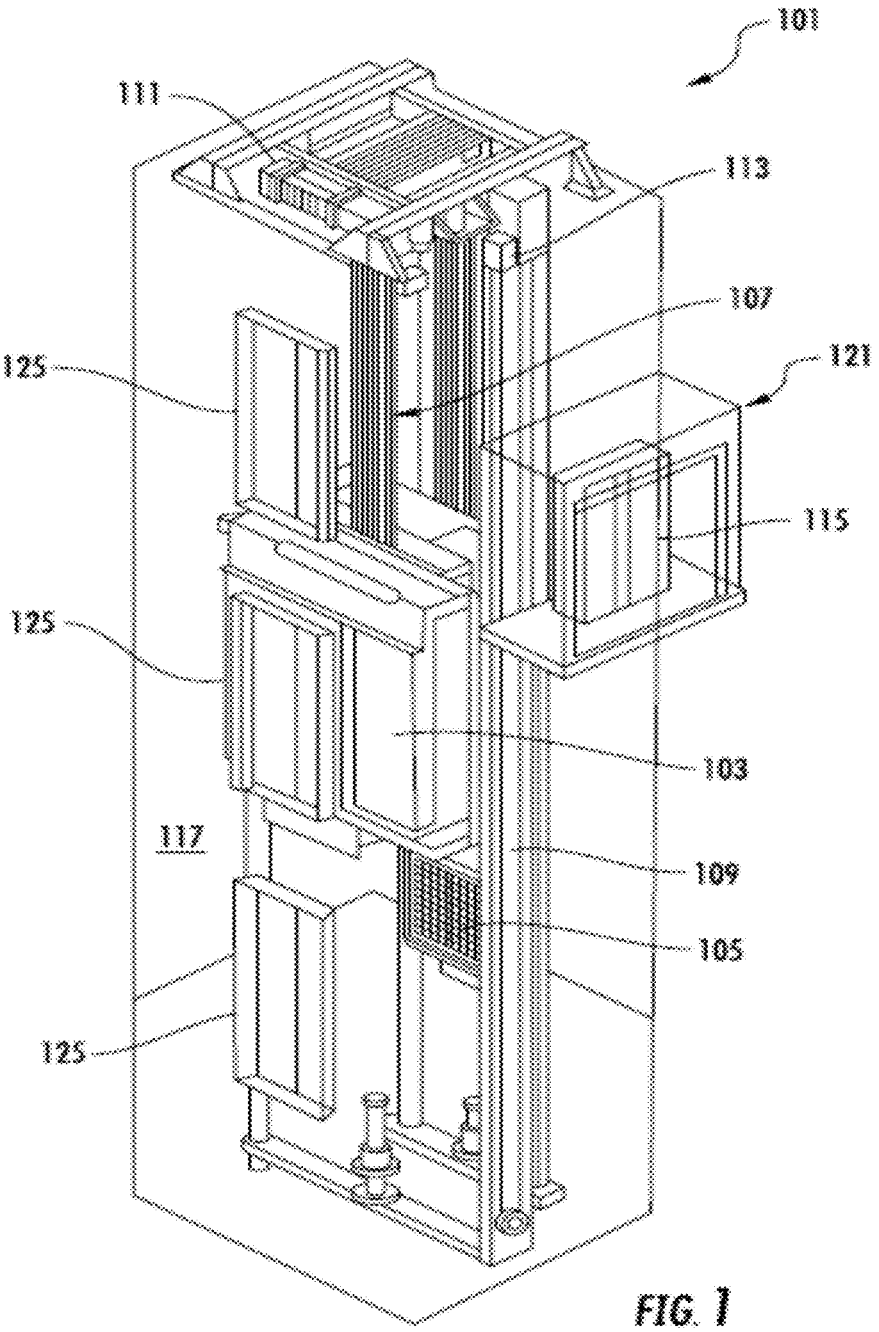
FIG. 1 depicts a schematic illustration of an elevator system that may employ various embodiments of the present disclosure.

FIG. 1 is a perspective view of an elevator system 101 including an elevator car 103, a counterweight 105, a tension member 107, a guide rail 109, a machine 111, a position reference system 113, and a controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator hoistway 117 and along the guide rail 109.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator hoistway 117, such as on a support or guide rail, and may be configured to provide position signals related to a position of the elevator car 103 within the elevator hoistway 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counter weight, as known in the art. For example, without limitation, the position reference system 113 can be an encoder, sensor, or other system and can include velocity sensing, absolute position sensing, etc., as will be appreciated by those of skill in the art.

The controller 115 is located, as shown, in a controller room 121 of the elevator hoistway 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position reference system 113 or any other desired position reference device. When moving up or down within the elevator hoistway 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101. In one embodiment, the controller may be located remotely or in the cloud.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator hoistway 117.

Although shown and described with a roping system including tension member 107, elevator systems that employ other methods and mechanisms of moving an elevator car within an elevator hoistway may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. FIG. 1 is merely a non-limiting example presented for illustrative and explanatory purposes.

In other embodiments, the system includes a conveyance system that moves passengers between floors and/or along a single floor. Such conveyance systems may include escalators, people movers, etc. Accordingly, embodiments described herein are not limited to elevator systems, such as that shown in FIG. 1.

Figure 2:
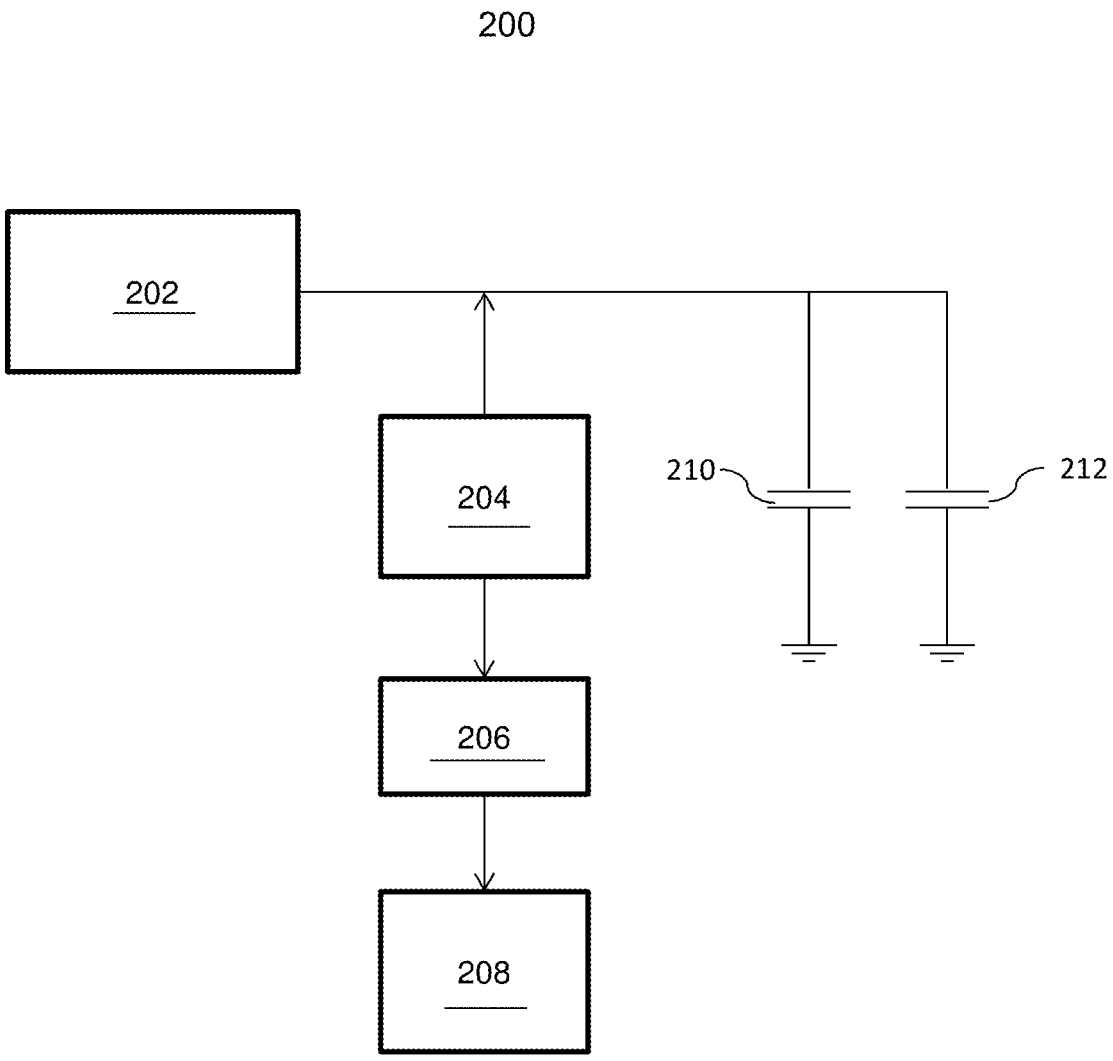
FIG. 2 depicts an elevator door safety control system in accordance with one or more embodiments.

Now referring to FIG. 2, a touch-sensing circuitry for the elevator safety control system 200 is shown. FIG. 2 includes an energy source 202, such as an AC generator, that is coupled to the elevator doors and/or elevator door frame. Also included in the touch-sensing circuitry is a current sensor 204 that detects a change in an electric current flowing through the elevator door or frame based on a person or object making contact with the monitored surface. In one or more embodiments, the current sensor 204 is electrically coupled to the elevator door.

In addition, the current sensor 204 is coupled to a flip flop circuit 206 which determines a state based on whether a person or object has contacted the surface, and provides a signal to an elevator controller 208 that controls the operation of the opening and closing of the elevator doors based on the signal.

In one or more embodiments, the energy source 202 is an AC generator that is configured to charge one or more portions of the elevator system such as the elevator doors and/or elevator door frame. The elevator door and/or elevator door frame can be composed of metal or other type of material that is capable of holding a charge in a predictable manner In some embodiments, the existing door and/or frame are made of metal, and therefore, no other additional components are required to convert the door and/or frame into a touch-sensing configuration. In other embodiments, additional equipment can be added to the door and/or frame to modify the design of which a current sensor monitors whether detection has been made with the surface such as sheets and coatings.

In one or more embodiments, the current sensor 204 is configured to detect electric current flow through a wire. In this example, the electric current that is provided to the one or more portions of the elevator system such as the elevator door and/or frame is detected. This electric current can be monitored, displayed, and/or stored for various data acquisition or control processes.

As shown in FIG. 2, the one or more portions of the elevator system are associated with a capacitance which is based on its ability to hold a charge. For example, the elevator door exhibits a capacitance represented by a capacitor 210 which is measurable and behaves in a predictable manner when contacted by human skin or other objects. The human body is also associated with a capacitance and is represented in FIG. 2 as a capacitor 212. Therefore, when contact is made with the charged surface, such as the elevator door, the charge can be discharged through the contacted surface which provides a path to ground causing a change in electric current flow which can be detected.

In a non-limiting example, when human skin contacts the metal elevator door panel, the current provided to the door begins to drain through the path provided by the human skin to ground. Upon detection of the increased current by the current sensor 204, a signal is sent to the flip-flop 206 to provide an indication to the elevator controller 208 that an obstruction or contact has been detected.

Based on the detection, the elevator controller 208 can be configured to control the behavior of the elevator doors. For example, the elevator controller 208 can stop the opening and/or closing of the elevator doors. In another example, the elevator controller 208 can reverse the direction of the elevator door upon the detection. In a different example, the elevator controller 208 can be configured to take action after a configurable delay to provide an opportunity for the obstruction to clear. The elevator controller 208 can also be configured to reduce the speed of the opening and closing of the elevator doors based on sensing a current change by the current sensor.

For example, in the event an obstacle or interference is detected while the elevator doors are in the opening direction, the elevator controller 208 can operate the elevator doors to stop immediately or reverse its direction. In another example, upon detection, the speed of the operation of the elevator doors can be reduced.

In a non-limiting example, if an elevator is equipped with multiple current sensors monitoring the different locations of the system such as the doors and the frame, when an object is detected on the door the speed of operating the doors can be decreased and if detected on the frame the doors may be immediately stopped because the obstacle can appear to be closer to the pinch point existing between the elevator doors and the wall.

In another non-limiting example, if the obstacle is detected while the doors are operating in the closing direction, the elevator controller 208 can operate the elevator doors to stop immediately, reverse its direction, reduce the speed of the opening closing of the doors, or any combination thereof. In addition, the elevator behavior can be based on detecting the obstacle at a first location or second location such as the elevator door or frame, respectively.

The detection can be sensed on one or more elevator doors or portions of the door frames. It is to be understood that the elevator controller can be configured to control the behavior of the elevator in any number of combinations and the examples provided above are only for illustrative purposes. The various locations of the elevator system can be detected by having separate touching sensing circuitry, such as that shown in FIG. 2, applied to the different positions of the elevator where the elevator controller 208 can determine the location sensed and the operation to execute.

In one or more embodiments, the elevator controller 208 can be configured to provide a notification to the passengers travelling in the elevator car, that an obstruction has been detected. The notification can be provided by a visual and/or audible indication.

Figure 3:
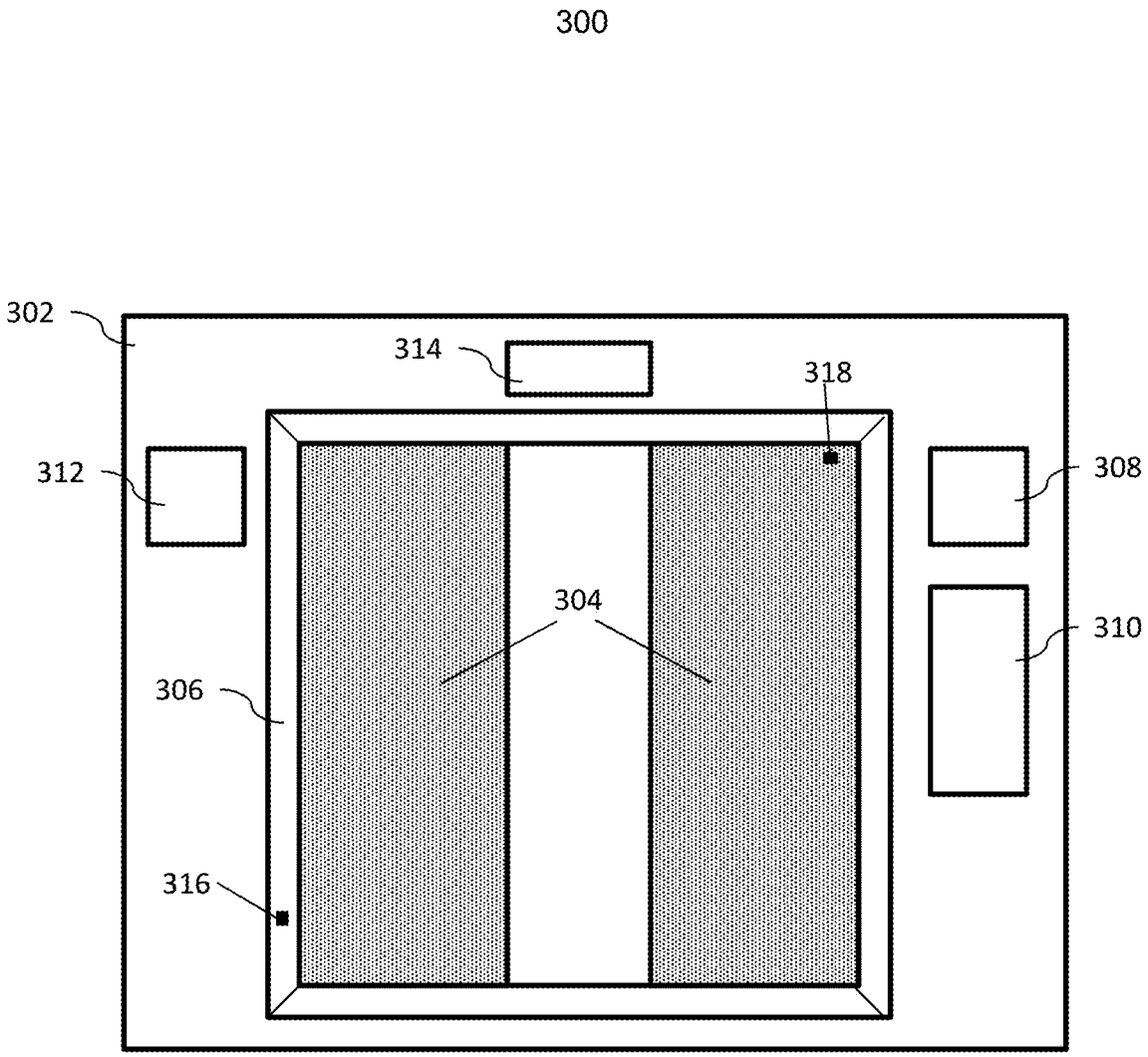
FIG. 3 depicts a view of the elevator door safety control system in accordance with one or more embodiments.

Now referring to FIG. 3, an example view of the elevator configuration is provided. The perspective view 300 of the elevator system 302 shown in FIG. 3 can be implemented in the system shown in FIG. 1. The elevator system 302 includes the elevator doors 304 which retract into the elevator walls next to the frame 306. The clearance between the elevators doors 304 and walls/frame 306 where the interface between the elevator doors 304 and walls/frame 306 results in a pinch point.

The elevator system 302 also includes a display 308, elevator floor selection panel 310, speaker/microphone 312, and floor status 314. Upon detection by the current sensor 204 of FIG. 2 a visual indication can be provided to the travelling passengers through the display 308 and/or an audible indication provided through the speaker 312. The locations 316, 318 are electrically coupled to an energy source and current sensor to monitor the detection of contacting a person or object.

Figure 4:
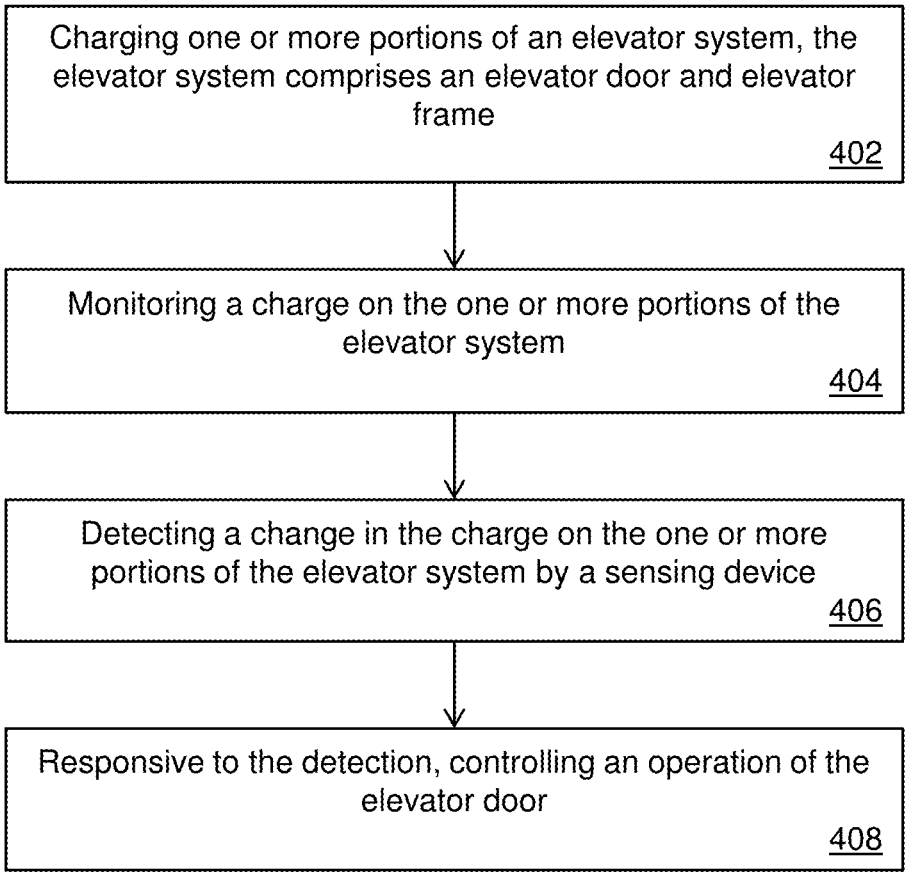
FIG. 4 depicts a flow chart for operating an elevator door safety control system in accordance with one or more embodiments.

Referring now to FIG. 4, a method 400 for operating an elevator safety control system in accordance with one or more embodiments is shown. The method 400, at block 402, provides for charging one or more portions of an elevator system, the elevator system includes an elevator door and elevator frame. In some embodiments, the charge provided by an energy source is an AC voltage/current and is provided to one or more elevator doors. In other embodiments, the AC charge is provided to one or more portions of the elevator door frame. The one or more portions of the elevator system include charging the elevator doors and/or elevator door frame associated with the elevator doors to be monitored. The elevator doors and/or frames can be composed of metal or other material that is capable of being charged by the energy source in a predictable manner to detect a change in current flowing through the charged surface.

Block 404 of method 400 provides for monitoring a charge on the one or more portions of the elevator system. A current sensor is electrically coupled to the elevator door and/or frame to monitor any changes in the current that is flowing through the elevator systems. It should be understood that multiple current sensors can be used to detect the current flow in different parts of the elevator system. Proceeding to block 406, the method 400 provides for detecting a change in the charge on the one or more portions of the elevator system by a sensing device. In one or more embodiments, the sensing device is a sensor in a detection system including a plurality of sensors such as light curtains, proximity sensors, load-sensing devices, etc. In addition, the signal transmitted by the sensing device can be integrated with signals from the additional sensors to determine an action (stop, slow, reversing the operation of the elevator door) for passenger safety.

At block 408, the method 400 provides for controlling operation of the elevator door responsive to the detection. In one or more embodiments, the elevator doors are controlled by an elevator controller and can be configured to be immediately stopped upon detection of an increased current flow through a monitored surface of the elevator system such as the elevator door and/or frame. In a different embodiment, the elevator controller can be configured to reverse the direction of the doors upon detection of the increased current.

In one or more embodiments, the speed of the door opening and/or closing can be decreased in response to the location of the detection of the increased current which provides a travelling passenger the opportunity to remove any obstacles or interferences from the pinch points of the elevator system.

The technical benefits and effects include operating the elevator in a safety mode to enhance passenger safety from unexpectedly contacting various pinch points that exist in the designs of elevator systems. The benefits also include the ability to apply the elevator control safety system to current elevator systems without having to replace existing elevator doors or add a surface that can be monitored. The safety feature provided by the touch-sensitive circuitry can be easily added to the elevator system to improve the safety for travelling passengers.

A detailed description of one or more embodiments of the disclosed apparatus and method are presented herein by way of exemplification and not limitation with reference to the Figures.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A method for operating a sensing device of an elevator safety control system, the method comprising:

charging one or more portions of an elevator system, the elevator system comprises an elevator door and elevator frame;

monitoring a charge on the one or more portions of the elevator system;

detecting, by the sensing device, a change in the charge on the one or more portions of the elevator system that have been charged, wherein detecting the change in the charge comprises detecting an electric current flowing through the elevator door or the elevator frame; and responsive to the detection, controlling an operation of the elevator door.

2. The method of claim 1, wherein the operation of the elevator door is reversed responsive to the detection.

3. The method of claim 1, wherein the operation of the elevator door is at stopped responsive to the detection.

4. The method of claim 1, wherein operation of the elevator door resumes after a configurable delay and detecting normal operating current in the elevator.

5. The method of claim 4, wherein the operation of the elevator door reduces a speed of the elevator door responsive to the detection.

6. The method of claim 4, wherein the operation of the elevator door reduces a speed of the elevator door in the reverse direction responsive to the detection.

7. The method of claim 1, wherein at least one of the elevator door or the elevator frame is composed of metal capable of being charged by the energy source.

8. The method of claim 1, further comprises operating the elevator door according to a first operation upon the detection in a first location based on operating in a first direction and operating the elevator door according to a second operation upon the detection in a second location, wherein the first operation is different than the second operation and the first location is different than the second location.

9. An elevator control safety system, the system comprising:

one or more elevator cars of an elevator system, the one or more elevator cars each include an elevator door and frame;

an energy source coupled to the one or more elevator cars to charge the elevator door or the elevator frame;

a current sensor electrically coupled to the energy source and the one or more elevator cars to perform a detection, wherein the detection comprises detecting an electric current flowing through the elevator door or the elevator frame; and an elevator controller operably coupled to the current sensor and the elevator system, the elevator controller configured to control the elevator door responsive to a signal received from the current sensor.

10. The system of claim 9, wherein the operation of the elevator door is reversed responsive to the detection.

11. The system of claim 9, wherein the operation of the elevator door is stopped responsive to the detection.

12. The system of claim 9, wherein operation of the elevator door resumes after a configurable delay and detecting normal operating current in the elevator.

13. The system of claim 12, wherein the operation of the elevator door reduces a speed of the elevator door responsive to the detection.

14. The system of claim 12, wherein the operation of the elevator door reduces a speed of the elevator door in the reverse direction responsive to the detection.

15. The system of claim 9, wherein at least one of the elevator door or the elevator frame is composed of metal capable of being charged by the energy source.

16. The system of claim 9, further comprises operating the elevator door according to a first operation upon the detection in a first location based on operating in a first direction and operating the elevator door according to a second operation upon the detection in a second location, wherein the first operation is different than the second operation and the first location is different than the second location.

* * * * *